US010563426B2

(12) United States Patent
Vornbrock

(10) Patent No.: US 10,563,426 B2
(45) Date of Patent: Feb. 18, 2020

(54) BLOCKING DEVICE AND SYSTEM FOR MECHANICAL LOCK

(71) Applicant: Andre John Vornbrock, Hillsborough, NC (US)

(72) Inventor: Andre John Vornbrock, Hillsborough, NC (US)

( * ) Notice: Subject to any disclaimer, the term of this patent is extended or adjusted under 35 U.S.C. 154(b) by 121 days.

(21) Appl. No.: 15/944,773

(22) Filed: Apr. 3, 2018

(65) Prior Publication Data

US 2018/0298644 A1 Oct. 18, 2018

Related U.S. Application Data

(60) Provisional application No. 62/486,075, filed on Apr. 17, 2017.

(51) Int. Cl.

| | |
|---|---|
| ***E05B 47/00*** | (2006.01) |
| ***E05B 17/04*** | (2006.01) |
| *E05B 27/00* | (2006.01) |

(52) U.S. Cl.

CPC ..... *E05B 47/0044* (2013.01); *E05B 17/047* (2013.01); *E05B 47/0042* (2013.01); *E05B 27/006* (2013.01); *E05B 27/0021* (2013.01)

(58) Field of Classification Search

CPC . E05B 47/0042; E05B 27/006; E05B 27/0067

See application file for complete search history.

(56) References Cited

U.S. PATENT DOCUMENTS

| | | | | |
|---|---|---|---|---|
| 3,935,720 A * | 2/1976 | Boving | ..... | E05B 47/0042 70/276 |
| 4,084,416 A | 4/1978 | Prunbauer | | |
| 4,377,940 A * | 3/1983 | Hucknall | ..... | E05B 15/1614 70/378 |

OTHER PUBLICATIONS

YouTube video titled "EVVA MCS—Gen 1—Full Pick & Gut" by Lockfall Laboratories, published on Mar. 27, 2017, and available at https://www.youtube.com/watch?v=Yg5PA_A-7YI.*

YouTube video titled "Evva MCS Animation" by Jon King, published on Oct. 3, 2011, and available at https://www.youtube.com/watch?v=bNTqJtdmZOE.*

* cited by examiner

*Primary Examiner* — Blake A Tankersley

(57) ABSTRACT

Blocking devices to stop movement of mechanical or magnetic coded rotors, pins or discs immediately when the plug is turned.

1 Claim, 4 Drawing Sheets

BLOCKING DEVICE AND SYSTEM FOR MECHANICAL LOCK

BACKGROUND OF THE INVENTION

This invention relates generally to an arresting control device and more particularly it relates to a control device for a mechanical or magnetic cylinder lock having a stationary cylindrical housing and a rotatable plug arranged in the housing with a specialized blocking system.

Other locks fail to protect their coded locking system from manipulation and picking based attacks.

SUMMARY OF THE INVENTION

The primary object of this invention is to provide an improved control device which permits the actuation of the plug in a lock with a mechanical or magnetically coded key, whereby the decoding of the lock is rendered more difficult.

In keeping with this object is the addition of a blocking device to stop movement of mechanical or magnetic coded rotors, pins or discs immediately when the plug is turned. This novel addition prevents direct manipulation of the rotors/pins/discs with the intention that the lock can only be opened by an authorized key.

The blocking system is comprised of several bars that retract and press against the coded rotary or axial members. When engaged the coded rotor gate positions are fixed and no movement of them is possible. In other locks, this movement can be used to decode the position of a gate by testing to see if it moves or is binding. The blocking system ensures that all rotors/pins/discs are held tight and no such information can be gathered on the lock.

DETAILED DESCRIPTION OF THE INVENTION

Figure 1:
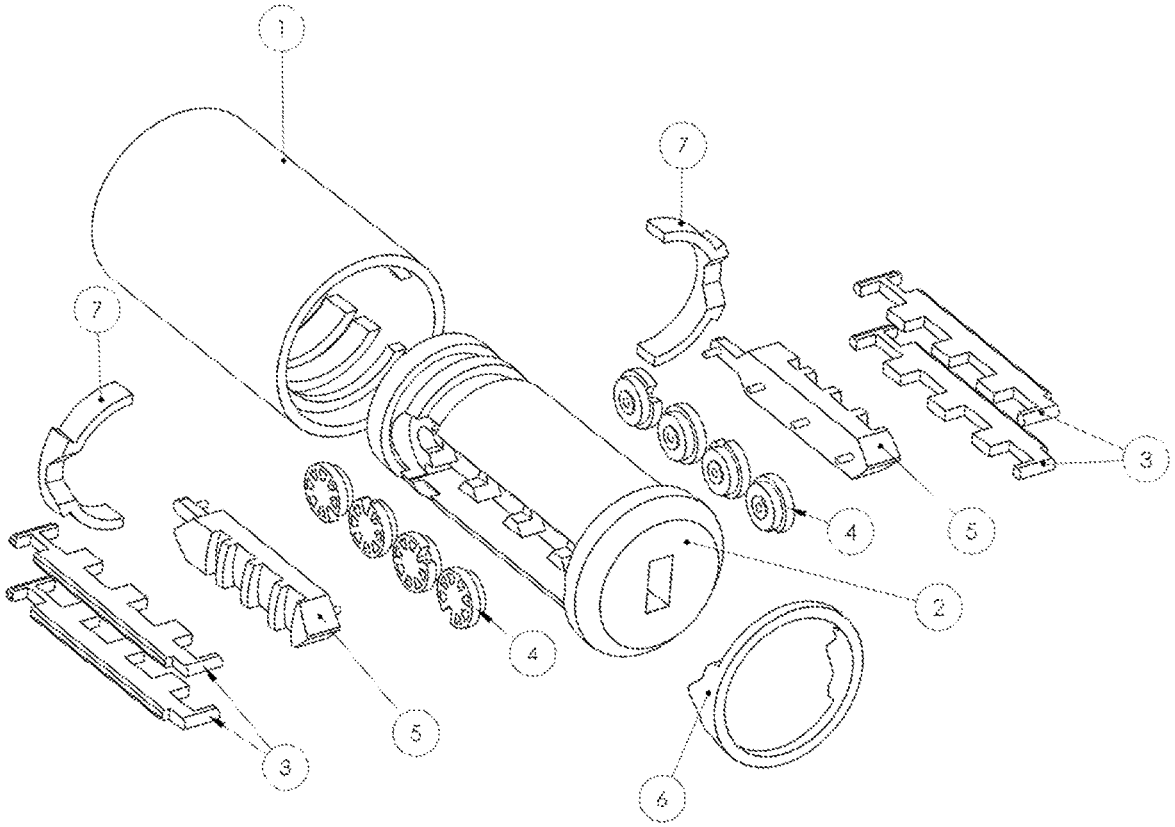
FIG. 1 is an exploded perspective view example of a lock of the present invention.

Referring now to the invention in more detail, FIG. 1 shows parts of a cylinder lock according to the invention. The control device of this invention includes a stationary housing 1 defining a cylindrical passage in which a cylindrical plug 2 is arranged for rotation about its center axis.

Plug 2 defines a central key channel into which a magnetically coded key is insertable from the front.

Figure 2:
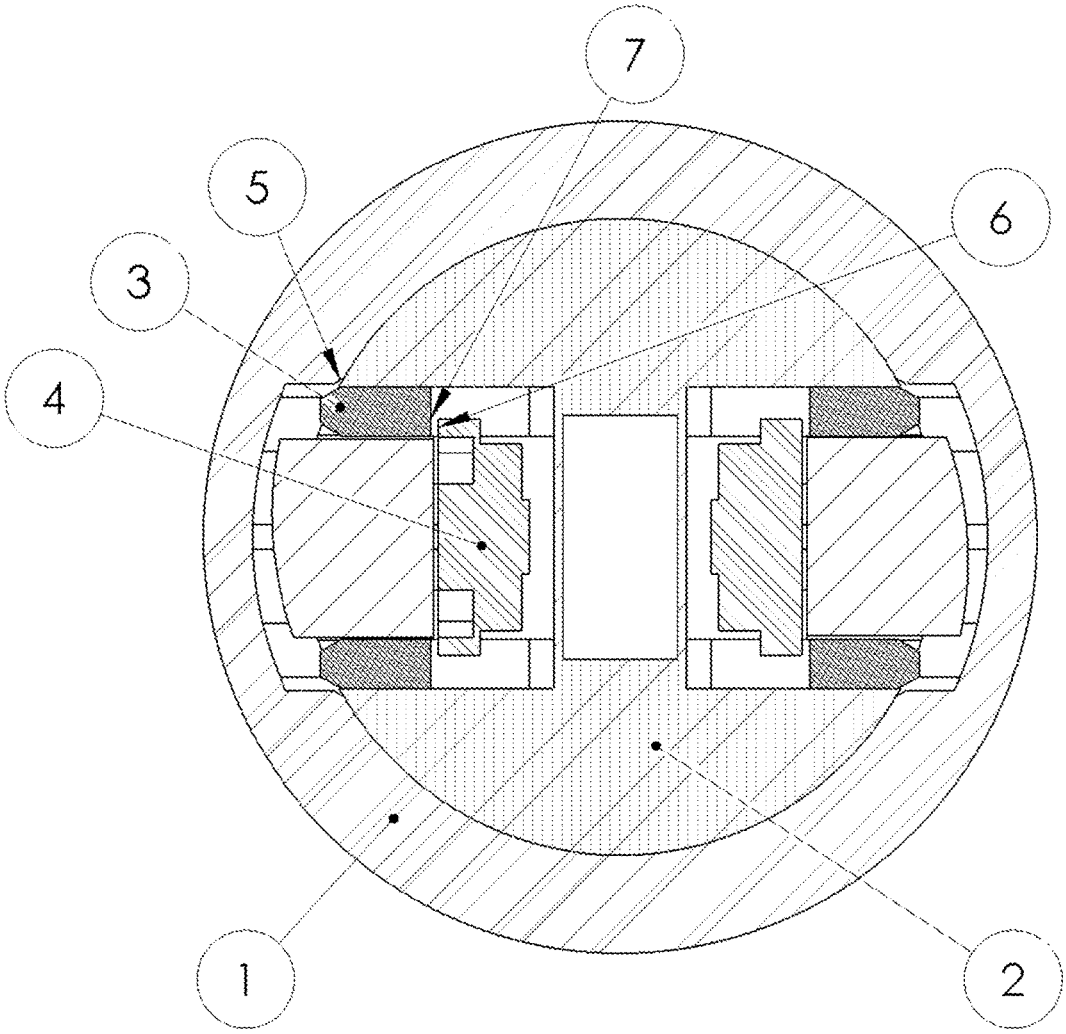
FIG. 2 is a cross-sectional front view of a part of the lock according to FIG. 1.

FIG. 2 shows a cross-sectional view from the front of the lock. Rotor blocking bar 3 is positioned so that when the core 2 is rotated respective to the housing 1 slightly, it will contact Point 5 and retract towards the center of the plug 2 until Point 7 touches rotary members 4 at point 6 preventing their movement entirely.

Figure 3:
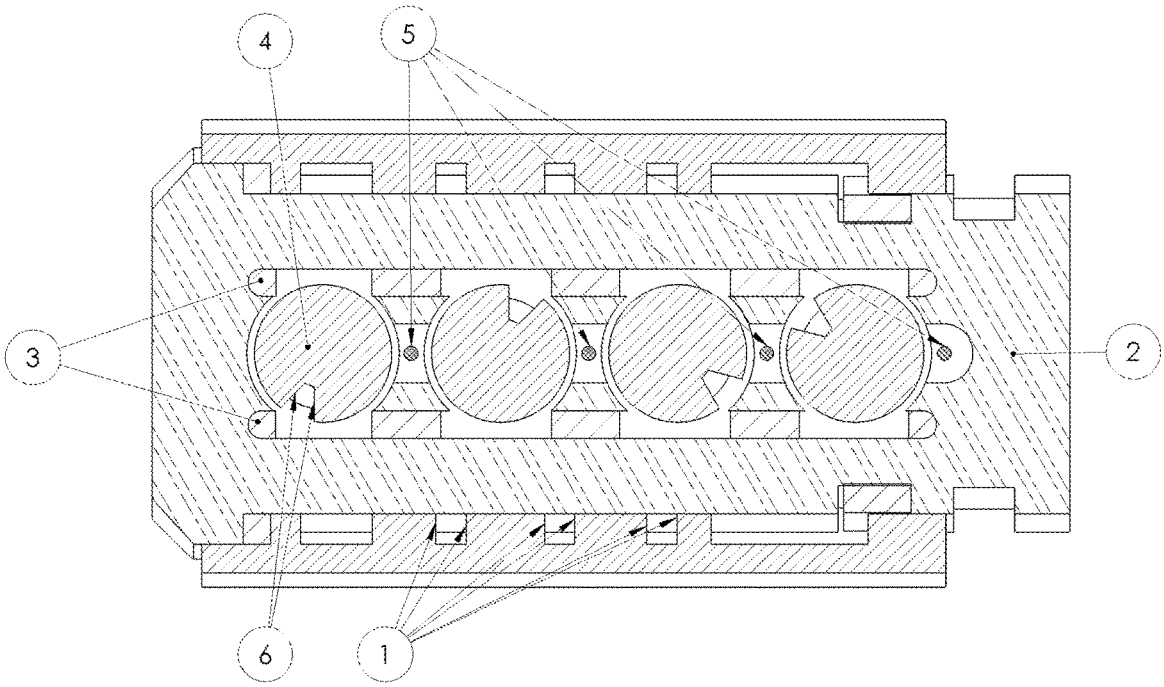
FIG. 3 is a cross-sectional side view of a part of the lock according to FIG. 1.
Figure 4:
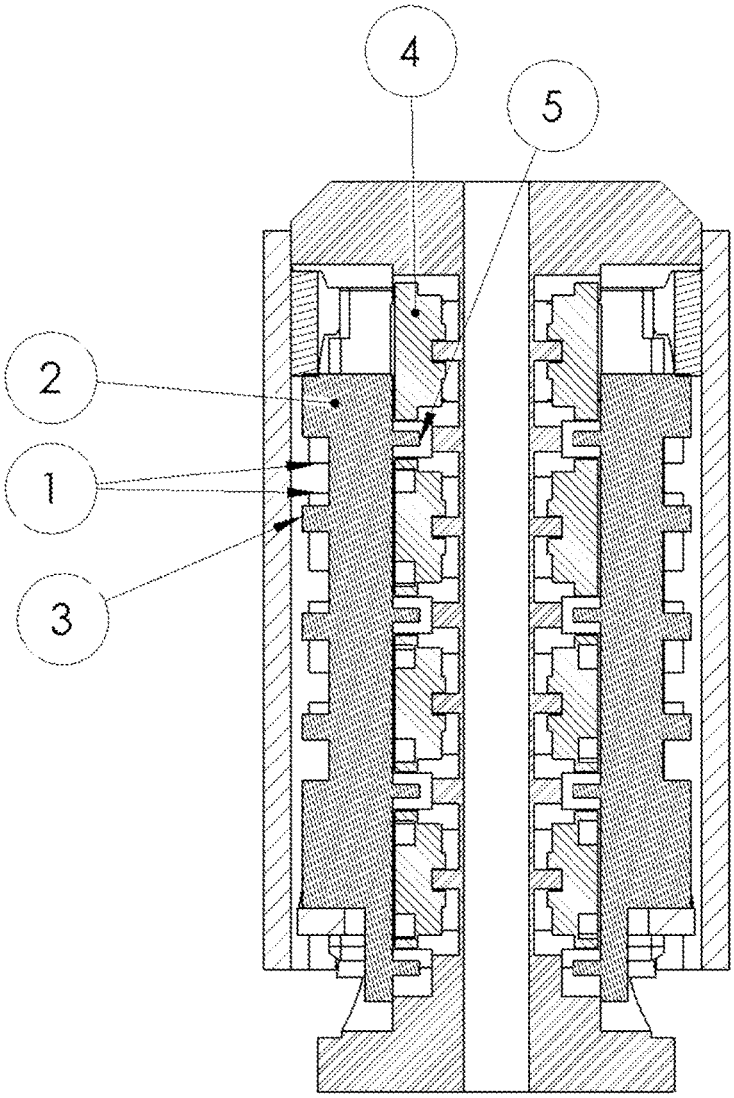
FIG. 4 is a cross-sectional top view of a part of the lock according to FIG. 1.

If rotation continues sidebar 2 in FIG. 4 will begin to travel up until pins 5 meet rotary members 4. If all pins 5 encounter correct gates 6 in FIG. 3, the sidebar 2 in FIG. 4 can continue travel forward until it is in the unlocked position. The unlocked position is determined by milling in the sidebar 3 in FIG. 4 to match up with counter-milling in the housing 1.

If any pin 5 does not encounter their respective correct gates 6 in FIG. 3, the sidebar 2 will not move and will arrest further movement of the plug 2. At this time a manipulation or picking attack cannot be successfully completed as the rotary members 4 are not movable. As the rotor members 4 are totally arrested in movement, no information of their position can be obtained either.

FIG. 3 shows the correct blocking bar channels 3 for the rotor blocking bar 3 in FIG. 1.

A key comprising of a coding to match rotors 4 in FIG. 1 would enter hole in the front of plug 2 to manipulate rotors 4 into their correct position. Upon turning said key, the blocking system would then engage to prevent any further rotor 4 movement. Sidebar 5 would then travel longitudinally forward until in the axial unlocked position relative to housing 1 and the plug 2 could rotate freely 360 degrees.

I claim:

1. A control device for use in a cylinder lock comprising, a. a housing defining a cylindrical passage;

b. a cylindrical plug that fits into said passage for rotational movement relative to said housing;

c. a keyhole through the front end of said plug;

d. a means between said plug and said housing for blocking the rotational movement in one axial position of said plug and for unblocking the rotational movement in another axial position thereof;

e. said plug having at least one longitudinal groove and a multiple of rotary members each supported for rotation about an axis transverse to said longitudinal groove; and f. blocking bars extending in a longitudinal direction of said cylindrical passage between said plug and said housing and which prevent said rotation of said rotary members in response to said cylindrical plug being rotated in said housing by moving in a radial direction of said cylindrical passage.

* * * * *